US006519981B1

(12) United States Patent
Lovak

(10) Patent No.: US 6,519,981 B1
(45) Date of Patent: Feb. 18, 2003

(54) ANTI-THEFT DEVICE FOR A LOWER UNIT OF AN OUTBOARD ENGINE AND STERN DRIVE

(76) Inventor: Edward Lovak, 2850 Greenway Blvd., Falls Church, VA (US) 22042

( * ) Notice: Subject to any disclaimer, the term of this patent is extended or adjusted under 35 U.S.C. 154(b) by 0 days.

(21) Appl. No.: 10/027,357

(22) Filed: Dec. 26, 2001

(51) Int. Cl.[7] ..... B63H 5/16

(52) U.S. Cl. ..... 70/18; 70/58; 70/164; 70/232; 70/DIG. 57; 416/247 A

(58) Field of Search ..... 70/164, 232, 58, 70/14, 18, DIG. 57; 114/221 R; 416/247 R, 247 A, 246, 244 B, 245 A, 146 B

(56) References Cited

U.S. PATENT DOCUMENTS

| | | | | | |
|---|---|---|---|---|---|
| 2,362,323 | A | * | 11/1944 | Stoppel | |
| 2,706,960 | A | * | 4/1955 | Crew | |
| 2,822,183 | A | * | 2/1958 | Montgomery | |
| 3,981,165 | A | | 9/1976 | Wersinger | 70/232 |
| 4,561,273 | A | * | 12/1985 | Robinson | 70/426 |
| 4,715,783 | A | * | 12/1987 | Wade | 70/232 X |
| 4,957,459 | A | * | 9/1990 | Snyder | 440/72 |
| 5,176,550 | A | * | 1/1993 | Hooper | 440/72 |
| 5,184,488 | A | * | 2/1993 | Sandlin | 70/14 |
| D358,076 | S | | 5/1995 | Woller et al. | D8/331 |
| 5,410,896 | A | * | 5/1995 | Gleason | 70/202 |
| 5,417,093 | A | * | 5/1995 | Heiberg | 70/232 |
| 5,469,721 | A | | 11/1995 | Pyle | 70/14 |
| 5,613,386 | A | | 3/1997 | Mire, Sr. | 70/232 |
| D379,143 | S | | 5/1997 | Alley | D8/346 |
| 5,778,706 | A | * | 7/1998 | Testa | 70/14 |
| 5,887,460 | A | * | 3/1999 | Williams | 70/18 |
| 6,018,968 | A | * | 2/2000 | Sides | 70/14 |

FOREIGN PATENT DOCUMENTS

| | | | | |
|---|---|---|---|---|
| CA | 951532 | * | 7/1974 | 70/232 |

* cited by examiner

*Primary Examiner*—Lloyd A. Gall
(74) *Attorney, Agent, or Firm*—Richard L. Miller

(57) ABSTRACT

An anti-theft device for a lower unit of an outboard engine including a collar extending around the outboard engine, pivoting apparatus operatively connected to the collar, and locking apparatus operatively connected to the collar and selectively maintaining the collar around the outboard engine. The collar includes a pair of legs pivotally attached to each other by the pivoting apparatus and longitudinally curved to conform to, extend along, and capture, the cavitation plate of the outboard engine. A pair of plates extend inwardly from the pair of legs and are shaped and positioned so as to cover an opposing pair of mounting bolts and any space therebetween so as to deny access thereto when the anti-theft device is in place. The terminal edges of the plate are tongue and grooved, respectively, so as to form a tongue and groove joint when the anti-theft device is in place.

4 Claims, 1 Drawing Sheet

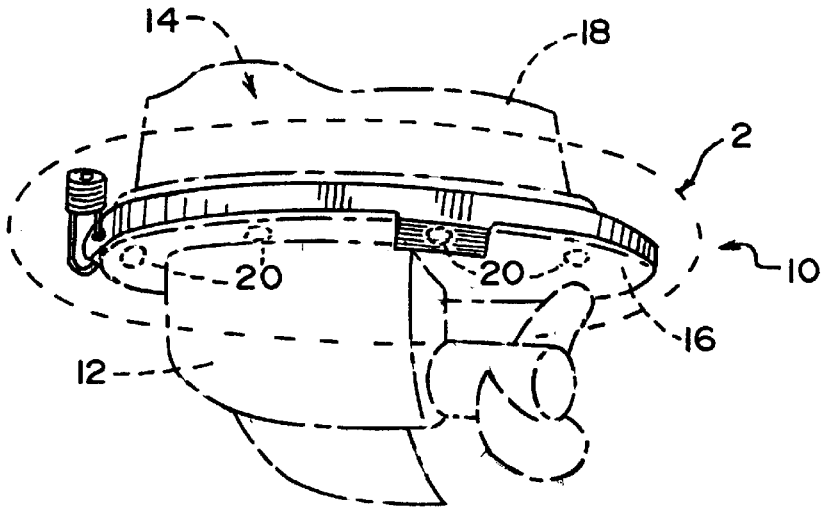
FIG. 1
FIG. 3
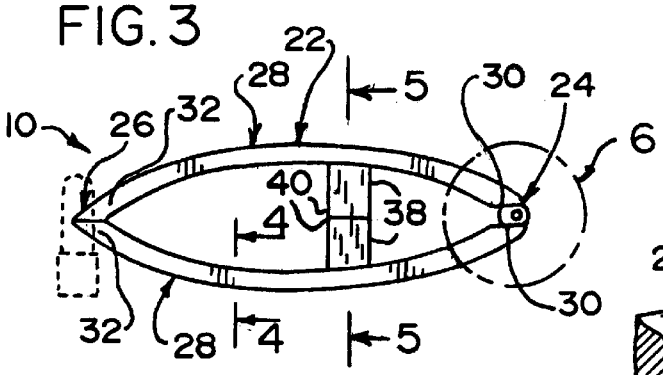
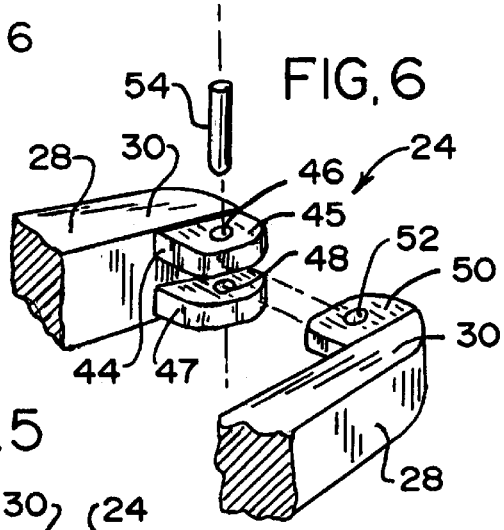
FIG. 6
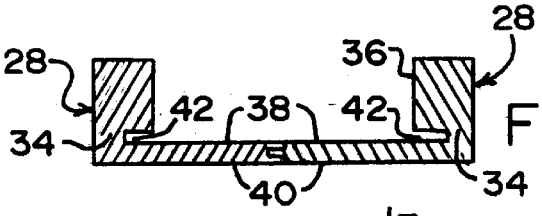
FIG. 5
FIG. 4
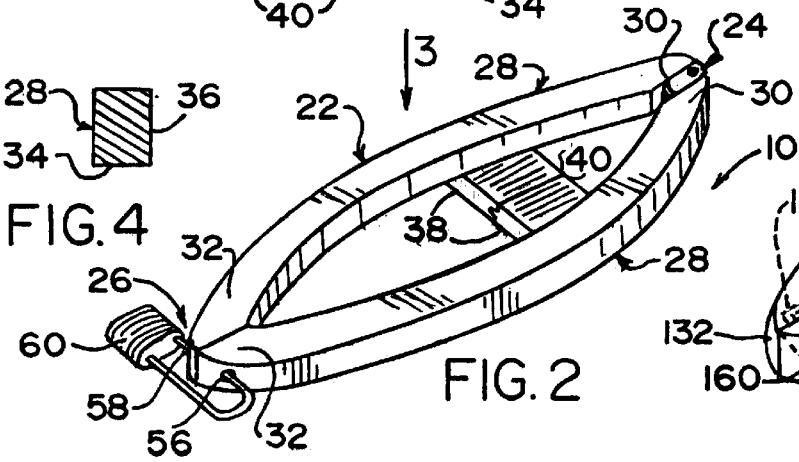
FIG. 2
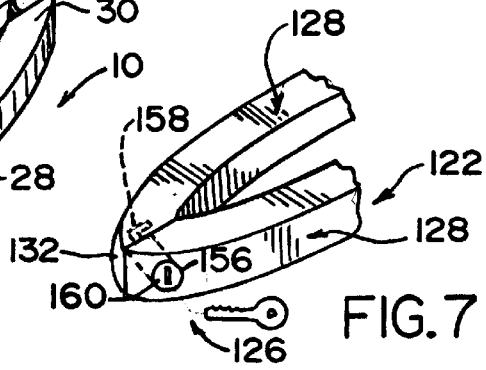
FIG. 7

ANTI-THEFT DEVICE FOR A LOWER UNIT OF AN OUTBOARD ENGINE AND STERN DRIVE

BACKGROUND OF THE INVENTION

1. Field of the Invention

The present invention relates to an anti-theft device. More particularly, the present invention relates to an anti-theft device for a lower unit of an outboard engine.

2. Description of the Prior Art

Numerous innovations for outboard engine anti-theft devices have been provided in the prior art that will be described. Even though these innovations my be suitable for the specific individual purpose to which they address, however, they differ from the present invention.

A first example, U.S. Pat. No. Des. 358,076 to Woller et al. teaches the ornamental design for an outboard marine engine lower unit and propeller lock.

A second example, U.S. Pat. No. Des. 379,143 to Alley teaches the ornamental design for a propeller anti-theft device.

A third example, U.S. Pat. No. 3,981,165 to Wersinger teaches a propeller lock system comprised of an inner fin lock and an outer fin lock, with the outer fin lock adapted to lock to the inner fin lock to prevent removal from its locking position on a propeller housing.

A fourth example, U.S. Pat. No. 5,469,721 to Pyle teaches a case and lock for reducing damage and deterring theft of boat propellers. The invention is comprised of a case for enclosing a boat propeller and a portion of a propeller drive unit. The case has a pair of pivotally connected members which are supported by a horizontal stabilizer fin of a propeller drive unit. The lock lockably connects the case members. One optional feature of the invention are running lights mounted on the sides of the lockable case members. Another optional feature is an electronic alarm which is activated during attempts to steal the propeller.

A fifth example, U.S. Pat. No. 5,613,386 to Mire, Sr. teaches a propeller lock for preventing unauthorized removal of a marine propeller from the drive shaft of a marine propeller gear housing, the marine propeller having a plurality of blades extending from a generally hollow cylindrical hub having an outer end and an inner end, the hub being connected to the drive shaft by a nut, the nut and the drive shaft being contained inside the hub and the outer end, including a cover for covering the outer end of the propeller to prevent removal of the nut, and rotatable clamps for connecting the cover to the propeller.

A sixth example, U.S. Pat. No. 5,778,706 to Testa teaches an anti-theft device for obstructing access to a nut securing a propeller on a drive shaft of an outboard engine assembly. The device comprises a two part yoke which partially encircles the housing of the engine assembly and its drive train at one end, and at its other end locates a cap over the nut threaded to the drive shaft. The two parts enable adjustment of the longitudinal dimension of the device, for so accommodating outboard engine assemblies of different dimensions. In alternative embodiments, two types of locks are provided. One type is an integral key operated locking cylinder. The other type accepts a conventional padlock. In a further alternative embodiment, the cap has projections for engaging propeller blades and preventing these blades from rotating when the device is installed.

It is apparent that numerous innovations for outboard engine anti-theft devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide an anti-theft device for a lower unit of an outboard engine that avoids the disadvantages of the prior art.

Another object of the present invention is to provide an anti-theft device for a lower unit of an outboard engine that is simple and inexpensive to manufacture.

Still another object of the present invention is to provide an anti-theft device for a lower unit of an outboard engines that is simple to use.

Briefly stated, still yet another object of the present invention is to provide an anti-theft device for a lower unit of an outboard engine including a collar extending around the outboard engine, pivoting apparatus operatively connected to the collar, and locking apparatus operatively connected to the collar and selectively maintaining the collar around the outboard engine. The collar includes a pair of legs pivotally attached to each other by the pivoting apparatus and longitudinally curved to conform to, extend along, and capture, the cavitation plate of the outboard engine. A pair of plates extend inwardly from the pair of legs and are shaped and positioned so as to cover an opposing pair of mounting bolts and any space therebetween so as to deny access thereto when the anti-theft device is in place. The terminal edges of the plate are tongue and grooved, respectively, so as to form a tongue and groove joint when the anti-theft device is in place.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the present invention in use;

FIG. 2 is an enlarged diagrammatic perspective view of the area generally enclosed by the dotted curve identified by arrow 2 in FIG. 1 of the present invention;

FIG. 3 is a reduced diagrammatic top plan view taken generally in the direction of arrow 3 in FIG. 2 of the present invention;

FIG. 4 is an enlarged cross sectional view taken on line 4—4 in FIG. 3 of a portion of the collar of the present invention;

FIG. 5 is an enlarged cross sectional view taken on line 5—5 in FIG. 3 of another portion of the collar of the present invention;

FIG. 6 is an enlarged exploded diagrammatic view of the area generally enclosed by the dotted carve identified by arrow 6 in FIG. 3 of the pivoting apparatus of the present invention; and FIG. 7 is a fragmented diagrammatic perspective view of another embodiment of the lock of the present invention.

LIST OF REFERENCE NUMERALS UTILIZED IN THE DRAWING

10 anti-theft device of present invention for lower unit 12 of outboard engine 14
12 lower unit of outboard engine 14
14 outboard engine
16 cavitation plate of outboard engine 14
18 out drive of outboard engine 14
20 plurality of bolts of outboard engine 14 attaching lower unit 12 of outboard engine 14 to out drive 18 of outboard engine 14 through cavitation plate 16 of outboard engine 14
22 collar for extending around outboard engine 14
24 pivoting apparatus
26 locking apparatus for selectively maintaining collar around outboard engine 14
28 pair of legs of collar 22 for conforming to, extending along, and capturing, cavitation plate 16 of outboard engine 14
30 proximal ends of pair of legs 28 of collar 22
32 distal ends of pair of legs 28 of collar 22
34 lowermost surfaces of pair of legs 28 of collar 22
36 innermost surfaces of pair of legs 28 of collar 22
38 pair of plates of collar 22 for covering opposing pair of bolts of plurality of bolts 20 and any space therebetween so as to deny access thereto when anti-theft device 10 is in place
40 pair of facing terminal edges of pair of plates 38 of collar 22
42 grooves in pair of plates 38 of collar 22 for capturing cavitation plate 16 of outboard engine 14 when anti-theft device 10 is in place
44 pair of first tabs of pivoting apparatus 24
45 uppermost first tab of pair of first tabs 44 of pivoting apparatus 24
46 throughbore extending axially through uppermost first tab 45 of pair of first tabs 44 of pivoting apparatus 24
47 lowermost first tab of pair of first tabs 44 of pivoting apparatus 24
48 blindbore in lowermost first tab 47 of pair of first tabs 44 of pivoting apparatus 24
50 second tab of pivoting apparatus 24
52 throughbore extending axially through second tab 50 of pivoting apparatus 24
54 pivot pin of pivoting apparatus 24

First Embodiment of Locking Apparatus 26

56 first throughbore in distal end 32 of one leg of pair of legs 28 of collar 22
58 second throughbore in distal end 32 of other leg of pair of legs 28 of collar 22
60 pad lock Second Embodiment of Looking Apparatus 126

122 collar
128 pair of legs of collar 122
132 distal end of other leg of pair of legs 128 of collar 122
156 first throughbore in distal end 132 of one leg of pair of legs 128 of collar 122
158 blindbore in distal end 132 of other leg of pair of legs 128 of collar 122
160 key-operated cylinder lock

DESCRIPTION OF THE PREFERRED EMBODIMENT

Referring now to the figures, in which like numerals indicate like parts, and particularly to FIG. 1, the anti-theft device of the present invention is shown generally at 10 for a lower unit 12 of an outboard engine 14. The outboard engine 14 has a cavitation plate 16 and an out drive 18 to which the lower unit 12 is attached by a plurality of bolts 20 that extend through the cavitation plate 16.

The overall configuration of the anti-theft device 10 can best be seen in FIGS. 2 and 3, and as such, will be discussed with reference thereto.

The anti-theft device 10 comprises a collar 22 for extending around the outboard engine 14, pivoting apparatus 24 that is operatively connected to the collar 22, and looking apparatus 26 that is operatively connected to the collar 22 and Is for selectively maintaining the collar 22 around the outboard engine 14.

The specific configuration of the collar 22 can best be seen in FIGS. 2–5, and as such, will be discussed with reference thereto.

The collar 22 comprises a pair of legs 28 that are pivotally attached to each other by the pivoting apparatus 24.

The pair of legs 28 of the collar 22 are slender, elongated, generally square in lateral cross section, and longitudinally curved for conforming to, extending along, and capturing, the cavitation plate 16 of the outboard engine 14.

The pair of legs 28 of the collar 22 have proximal ends 30 that are pivotally attached to each other by the pivoting apparatus 24, distal ends 32 that are free and selectively abutted against each other, and maintained abutted against each other, by the locking apparatus 26, lowermost surfaces 34, and innermost surfaces 36.

The collar 22 further comprises a pair of plates 38 that extend inwardly from the pair of legs 28 thereof, towards each other. The pair of plates 38 are shaped and positioned for covering an opposing pair of the plurality of bolts 20 and any space therebetween so as to deny access thereto when the anti-theft device 10 is in place.

The pair of plates 38 of the collar 22 are flat and extend inwardly from the lowermost surfaces 34 of the pair of legs 28 of the collar 22 to a pair of facing terminal edges 40.

The terminal edge 40 of one plate 38 is tongued and the terminal edge 40 of the other plate 38 is grooved so as to from a tongue and groove joint when the anti-theft device 10 is in place.

The pair of plates 38 of the collar 22 have grooves 42 that extend thereacross. The grooves 42 in the pair of plates 38 are disposed where the pair of plates 38 meet the pair of legs 28 and are for capturing the cavitation plate 16 of the outboard engine 14 when the anti-theft device 10 is in place.

The specific configuration of the pivoting apparatus 24 can best be seen in FIG. 6, and as such, will be discussed with reference thereto.

The pivoting apparatus 24 comprises a pair of first tabs 44 that are vertically spaced-apart and extend inwardly from the proximal end 30 of one leg 28, toward the proximal end 30 of the other leg 28. An uppermost first tab 45 has a throughbore 46 that extends axially therethrough, while a lowermost first tab 47 has a blindbore 48 that is in vertical alignment with the throughbore 46 in the uppermost first tab 45.

The pivoting apparatus 24 further comprises a second tab 50 that extends inwardly from the proximal end 30 of the other leg 28, toward the proximal end 30 of the one leg 28, and is positioned between the pair of first tabs 44. The second tab 50 has a throughbore 52 that extends axially therethrough and is in vertical alignment with the throughbore 46 in the uppermost first tab 45 and the blindbore 48 in the lowermost first tab 47.

The pivoting apparatus 24 further comprises a pivot pin 54 that extends into the throughbore 46 in the uppermost first tab 45, through the throughbore 52 in the second tab 50, and into the blindbore 48 in the lowermost first tab 47, with the blindbore 48 in the lowermost first tab 47 preventing the pivot pin 54 from being banged out.

The specific configuration of the locking apparatus 26 can best be seen in FIG. 2, and as such, will be discussed with reference thereto.

The locking apparatus 26 comprises the distal end 32 of one leg 28 having a first throughbore 56.

The looking apparatus 28 further comprises the distal end 32 of the other leg 28 having a second throughbore 58 that is aligned with the first throughbore 56, and together therewith, are for receiving a pad lock 60 when the anti-theft device 10 is in place.

An alternate embodiment of the looking apparatus 126 can best be seen in FIG. 7, and as such, will be discussed with reference thereto.

The locking apparatus 126 is similar to the locking apparatus 26, except:

1. The second throughbore 58 in the distal end 32 of the other leg 28 is a blindbore 158.
2. The pad lock 60 is replaced by a key-operated cylinder look 160 that is disposed in the first throughbore 158 in the distal end 132 of the one leg 128 and operatively extends into the blindbore 158 in the distal end 132 of the other leg 128.

It will be understood that each of the elements described above, or two or more together, may also find a useful application in other types of constructions differing from the types described above.

While the invention has been illustrated and described as embodied in an anti-theft device for a lower unit of an outboard engine, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute characteristics of the generic or specific aspects of this invention.

The invention claimed is:

1. An anti-theft device for a lower unit of an outboard engine, wherein the outboard engine has a cavitation plate and an out drive to which the lower unit is attached by a plurality of bolts that extend through the cavitation plate, said device comprising:

a) a collar;

b) pivoting apparatus; and c) locking apparatus;

wherein said collar is for extending around the outboard engine;

wherein said pivoting apparatus is operatively connected to said collar;

wherein said locking apparatus is operatively connected to said collar;

wherein said locking apparatus is for selectively maintaining said collar around the outboard engine;

wherein said collar comprises a pair of legs;

wherein said pair of legs of said collar are pivotally attached to each other by said pivoting apparatus;

wherein said pair of legs of said collar have proximal ends;

wherein said proximal ends of said pair of legs are pivotally attached to each other by said pivoting apparatus;

wherein said pair of legs of said collar have distal ends;

wherein said distal ends of said pair of legs are free;

wherein said distal ends of said pair of legs are selectively abutted against each other;

wherein said distal ends of said pair of legs are maintained abutted against each other by said locking apparatus;

wherein said pair of legs of said collar have lowermost surfaces;

wherein said pair of legs of said collar have innermost surfaces;

wherein said collar comprises a pair of plates;

wherein said pair of plates of said collar extend inwardly from said pair of legs thereof, towards each other;

wherein said pair of plates of said collar are flat;

wherein said pair of plates of said collar extend inwardly from said lowermost surfaces of said pair of legs of said collar to a pair of facing terminal edges;

wherein said terminal edge of one plate is tongued and said terminal edge of the other plate is grooved so as to from a tongue and groove joint when said anti-theft device is in place;

wherein said pair of legs of said collar have grooves;

wherein said grooves extend across said pair of legs of said collar;

wherein said grooves in said pair of legs are disposed just above said pair of plates;

wherein said grooves in said pair of legs are for capturing the cavitation plate of the outboard engine when said anti-theft device is in place;

wherein said pivoting apparatus comprises a pair of first tabs;

wherein said pair of first tabs of said pivoting apparatus; are vertically spaced-apart;

wherein said pair of first tabs of said pivoting apparatus extend inwardly from said proximal end of one leg, toward said proximal end of the other leg;

wherein an uppermost first tab has a throughbore that extends axially therethrough;

wherein a lowermost first tab has a blindbore;

wherein said blindbore in said lowermost first tab is in vertical alignment with said throughbore in said uppermost first tab;

wherein said pivoting apparatus comprises a second tab;

wherein said second tab of said pivoting apparatus extends inwardly from said proximal end of said other leg, toward said proximal end of said one leg;

wherein said second tab of said pivoting apparatus is positioned between said pair of first tabs;

wherein said second tab has a throughbore;

wherein said throughbore extends axially through said second tab;

wherein said throughbore in said second tab in vertical alignment with said throughbore in said uppermost first tab and said blindbore in said lowermost first tab;

wherein said pivoting apparatus comprises a pivot pin;

wherein said pivot pin of said pivoting apparatus extends into said throughbore in said uppermost first tab, through said throughbore in said second tab, and into said blindbore in said lowermost first tab;

wherein said blindbore in said lowermost first tab prevents said pivot pin from being banged out;

wherein said locking apparatus comprises said distal end of one leg having a first throughbore;

wherein said locking apparatus comprises said distal end of the other leg having a bore;

wherein said locking apparatus comprises a key-operated cylinder lock;

wherein said key-operated cylinder lock of said locking apparatus is disposed in said first throughbore in said distal end of said one leg; and wherein said key-operated cylinder lock of said locking apparatus operatively extends into said bore in said distal end of said other leg.

2. The device as defined in claim 1, wherein said pair of legs of said collar are slender;

wherein said pair of legs of said collar are elongated;

wherein said pair of legs of said collar are generally square in lateral cross section; and wherein said pair of legs of said collar are longitudinally curved for conforming to, extending along, and capturing, the cavitation plate of the outboard engine.

3. The device as defined in claim 1, wherein said pair of plates are shaped and positioned for covering an opposing pair of the plurality of bolts and any space therebetween so as to deny access thereto when said anti-theft device is in place.

4. The device as defined in claim 1, wherein said locking apparatus comprises said distal end of the other leg having a second throughbore;

wherein said second throughbore in said distal end of said other leg is aligned with said first throughbore in said distal end of said one leg; and wherein said second throughbore in said distal end of said other leg and said first throughbore in said distal end of said one leg are for receiving a pad lock when said anti-theft device is in place.

* * * * *